US007192302B2

(12) United States Patent
Phung et al.

(10) Patent No.: US 7,192,302 B2
(45) Date of Patent: Mar. 20, 2007

(54) INTEGRATED SEALABLE PLATE ASSEMBLY SYSTEM AND METHOD

(75) Inventors: Phillip Phung, Kirkland, WA (US); Patrick S. McNutt, Carnation, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/295,145

(22) Filed: Dec. 6, 2005

(65) Prior Publication Data

US 2006/0141858 A1 Jun. 29, 2006

Related U.S. Application Data

(60) Provisional application No. 60/633,425, filed on Dec. 6, 2004.

(51) Int. Cl.
*H01R 13/66* (2006.01)

(52) U.S. Cl. ..... 439/527; 174/58; 439/535

(58) Field of Classification Search ..... 439/527, 439/535–536, 271, 538, 544, 548, 559; 174/50, 174/53, 58, 66
See application file for complete search history.

(56) References Cited

U.S. PATENT DOCUMENTS

| | | | | |
|---|---|---|---|---|
| 4,794,207 | A * | 12/1988 | Norberg et al. | 174/505 |
| 5,189,256 | A * | 2/1993 | Epple | 174/50 |
| 6,384,334 | B1 * | 5/2002 | Webb | 174/58 |
| 6,423,897 | B1 * | 7/2002 | Roesch et al. | 174/50 |
| 6,808,283 | B2 * | 10/2004 | Tsao | 362/95 |
| 6,858,802 | B2 * | 2/2005 | Hagarty et al. | 174/58 |
| 6,956,169 | B1 * | 10/2005 | Shotey et al. | 174/58 |

* cited by examiner

*Primary Examiner*—Michael C. Zarroli
(74) *Attorney, Agent, or Firm*—Brian L. Johnson; George C. Rondeau, Jr.; Davis Wright Tremaine LLP

(57) ABSTRACT

An integrated sealable plate assembly for a sealable electrical or fiber optic connector can be used in industrial and other settings. The integrated sealable plate assembly has a plate with frame portions that are inserted into grooves of a gasket so that the plate and gasket can be coupled together as a unit for ready installation with the junction box. The gasket includes appendage portions with inner frame portions for sealing screw holes of the plate without need of conventional o-rings. When the plate and gasket are coupled together as a unit the appendage portions also serve to position and retain screws along with the plate and the gasket to further aid in installation.

13 Claims, 14 Drawing Sheets

INTEGRATED SEALABLE PLATE ASSEMBLY SYSTEM AND METHOD

BACKGROUND OF THE INVENTION

1. Field of the Invention

The present invention relates generally to plate gaskets and connectors, and more particularly to sealed electrical and fiber optic plate gaskets and connector assemblies.

2. Description of the Related Art

Sealable electrical connectors typically have a plug assembly that removably couples with a connector housing to provide a sealed engagement between the plug assembly and the connector housing. Engagement of the plug assembly and the connector housing provides an electrical connection between a cord, cable, or other such electrical conductor located typically within a room or other area and one or more wires of a cord or cable or other electrical conductor positioned inside of a junction box located typically behind a wall of a room or mounted to the wall.

The connector housing is generally sealably affixed to a plate with a seal positioned between a portion of the connector housing and a portion of the plate. The plate is sealably affixed to the junction box with small o-rings used as washers to received the screws and a gasket used to peripherally seal a perimeter portion of the plate to a perimeter portion of the junction box.

A sealable electrical connector can be used in a room or area having an adverse environment such that when the plug assembly and connector housing of the sealable electrical connector are fully engaged in a sealed condition, and associated electrically conductive elements such as tines or other type of electrical conductors being located either within the electrical connector are protected from hostile environmental elements. If nonsealable electrical connectors were used in these adverse environments, a potential exists that the nonsealable electrical connectors may expose associated electrically conductive elements to one or more harmful materials such as fluids, particulates, or other materials. These harmful materials could include gas vapors, particulates or liquids, which may produce explosions, short electrical circuits, or cause other detrimental effects.

Given the usefulness of the sealable electrical connector, it is understandable that the associated burden to attend to items such as the o-rings and gasket used to seal the plate would be conventionally accepted. Still problems exist such as potential for the plate not seating properly with the o-rings, the o-rings being lost before assembly, the gasket slipping during installation of the plate to the junction box, and the general burden of manufacturing and inventorying additional items such as the o-rings.

BRIEF DESCRIPTION OF THE SEVERAL VIEWS OF THE DRAWING(S)

DETAILED DESCRIPTION OF THE INVENTION

An integrated sealable plate assembly for a sealable electrical or fiber optic connector can be used in industrial and other settings. The integrated sealable plate assembly has a plate with peripheral frame portions that are inserted into grooves of peripheral frame portions of a gasket so that the plate and gasket can be coupled together as a unit for ready installation on a conventional junction box. The gasket includes appendage portions having inner frame portions for sealing screw holes of the plate without need of conventional o-rings. When the plate and gasket are coupled together as a unit, the inner frame portions of the appendage portions also serve to position and retain screws along with the plate and the gasket to further aid in installation.

Figure 1:
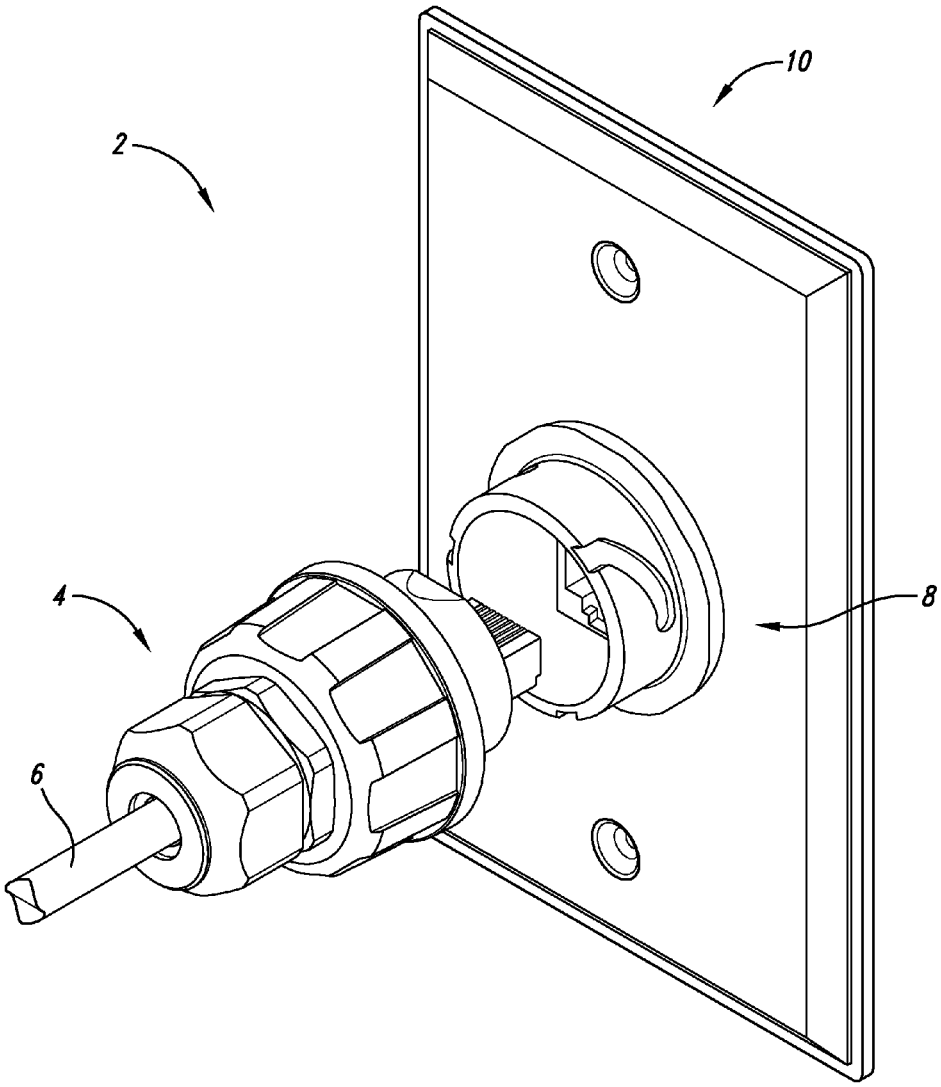
Fig. 1 Prior Art
FIG. 1 is an isometric view of a sealable electrical connector shown in an unsealed condition with its plug assembly disengaged from its connector housing held by a conventional plate assembly.
Figure 2:
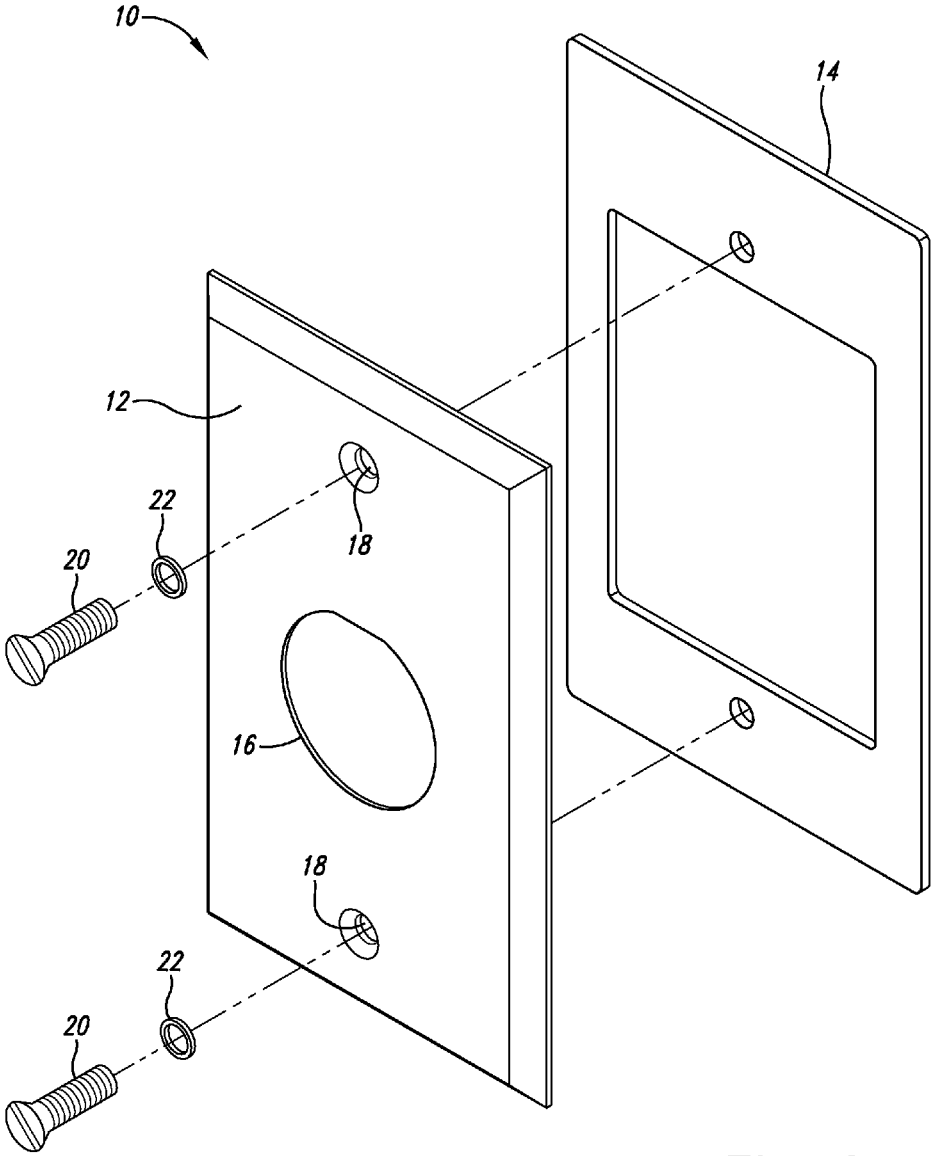
Fig. 2 Prior Art
FIG. 2 is an exploded isometric front view of the conventional plate assembly of FIG. 1.
Figure 3:
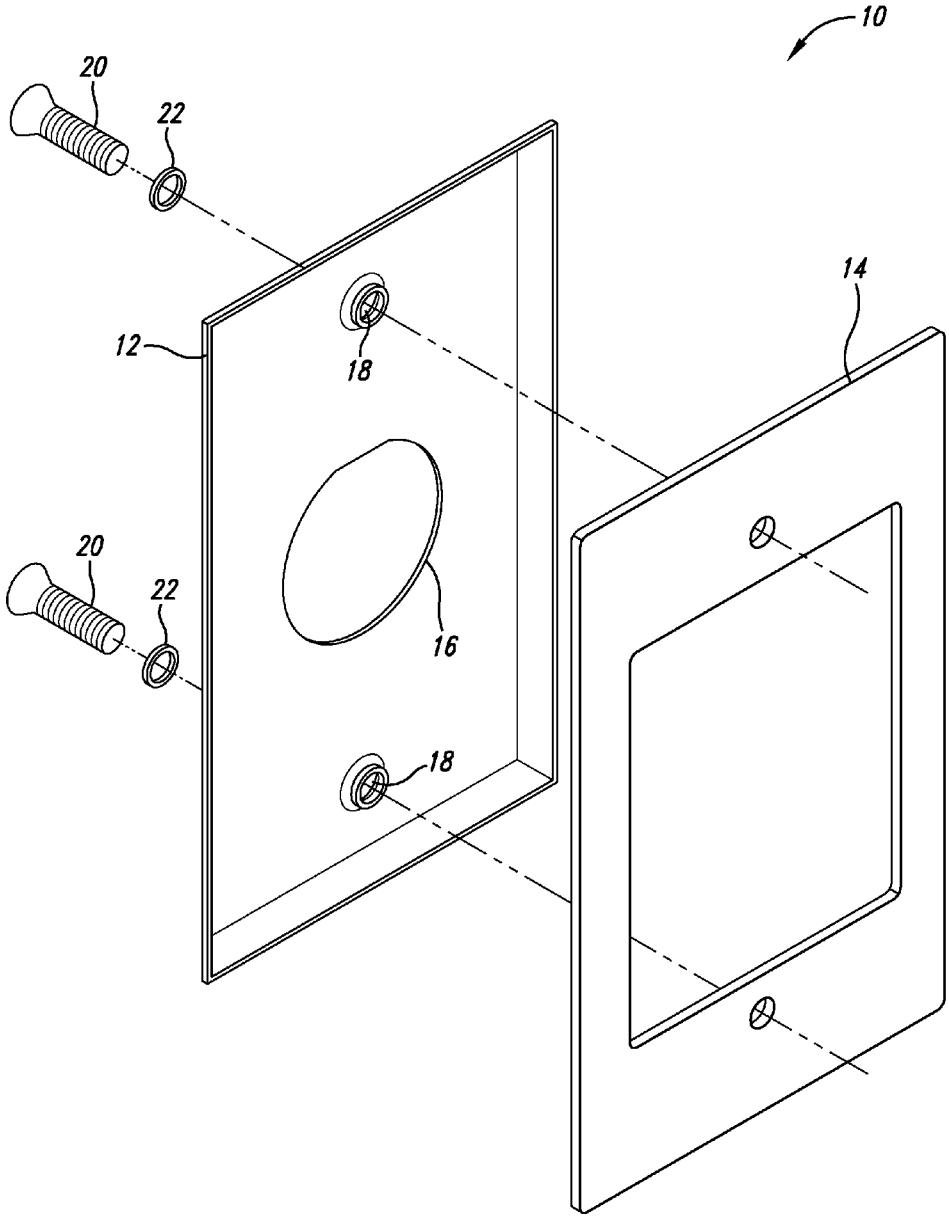
Fig. 3 Prior Art
FIG. 3 is an exploded isometric rear view of the conventional plate assembly of FIG. 2.

By way of background, a conventional sealable connector having a conventional plate assembly is first described. A conventional sealable connector 2 is shown in FIG. 1 as having a plug assembly 4 attached to a cable 6 to be coupled, a jack assembly 8 and a conventional plate assembly 10, having the jack assembly mounted thereto. As better shown in FIGS. 2 and 3, the plate assembly 10 has a plate 12 and a gasket 14 shaped to conform with the periphery of the plate in order to seal with the conventional junction box (shown in FIGS. 11 and 12).

The plate 12 includes a jack hole 16 sized to receive the jack assembly 8, screw holes 18 sized to receive screws 20 and positioned to couple the plate with the conventional junction box by way of the screws passing through the screw holes and engaging with similarly positioned threaded holes of the junction box. The plate assembly 10 further includes o-rings 22 made from a conformable material and used as washers for the screws 20 in order to seal between the edges of the holes 18 and the screws when the screws are fully inserted into the plate as shown in FIGS. 4 and 5.

Figure 4:
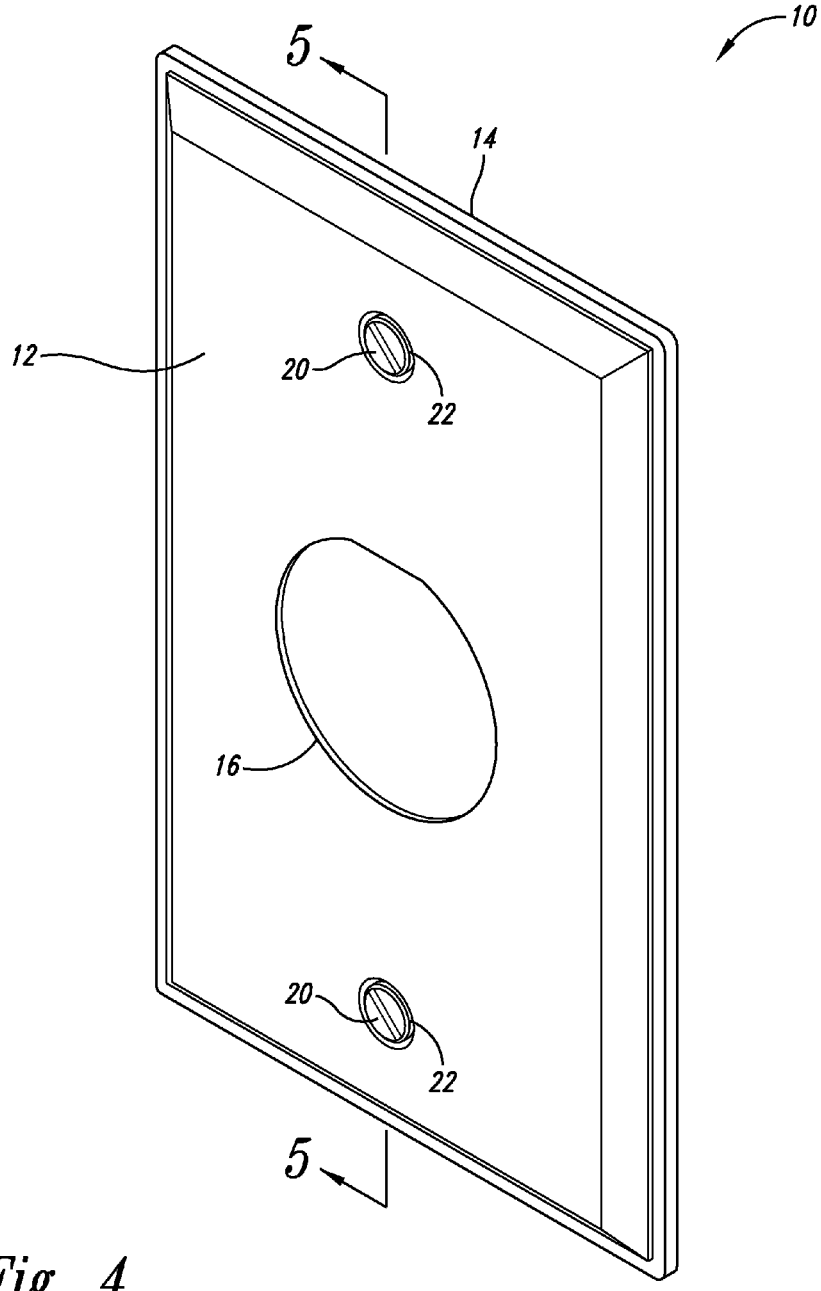
Fig. 4 Prior Art
FIG. 4 is an isometric front view of the conventional plate assembly of FIG. 2 shown assembled.
Figure 5:
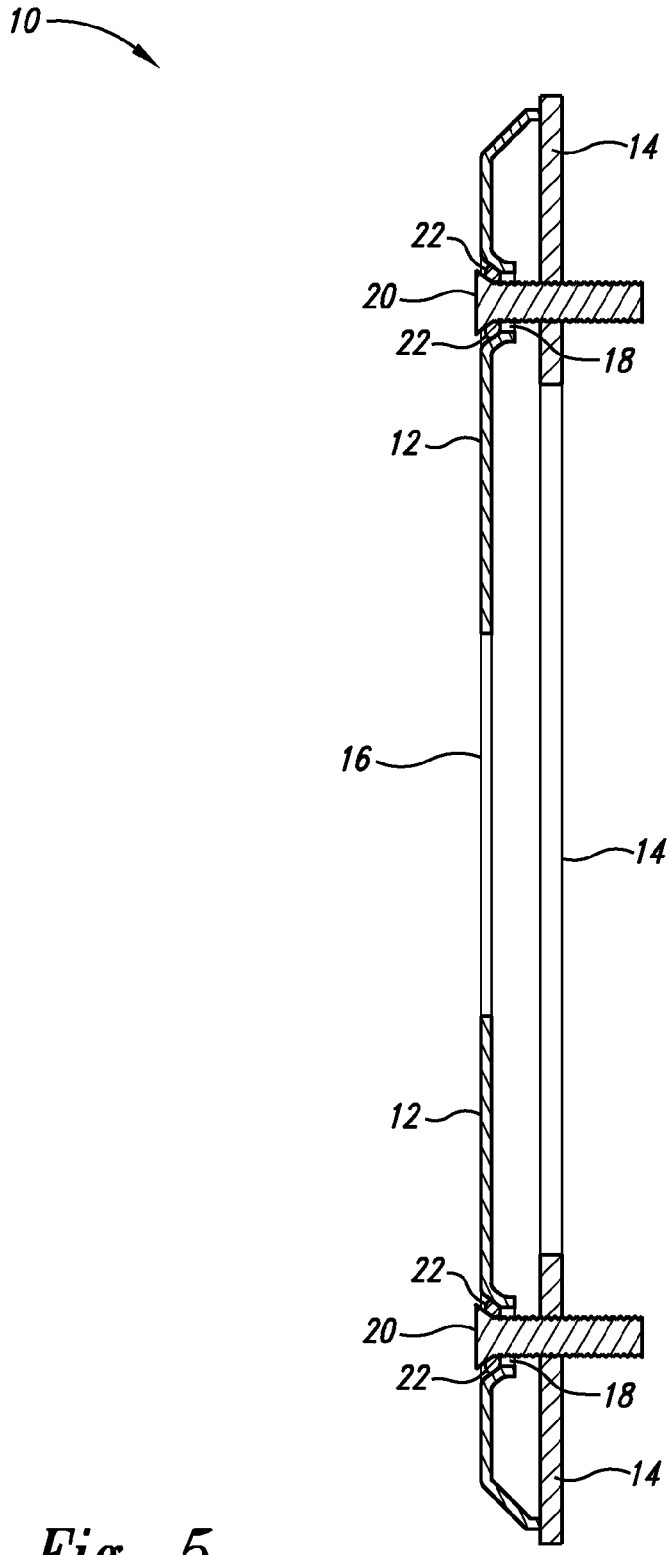
Fig. 5 Prior Art
FIG. 5 is a cross-sectional view of the conventional plate assembly taken substantially along the line 5—5 of FIG. 4.

The holes 18, screws 20, and o-rings 22 are so sized that the screws and the o-rings substantially protrude from the plate 12 when the screws are fully inserted into the plate, also shown in FIGS. 4 and 5. Improper positioning of the o-rings 22 with respect to the screws 20 may occur and may result in possible leakage. Other times, due to the rather diminutive nature of the o-rings, lack of attentiveness to the presence of the o-rings during installation may cause them to be misplaced or otherwise lost and result in possible slippage of an installation schedule due to their absence. As shown in FIG. 5, the length of the screws is typically substantial compared with the thickness of the plate 12, which could cause an unstable and unreliable positioning of the screws without assistance by nimble fingers of an installer (not shown).

Figure 6:
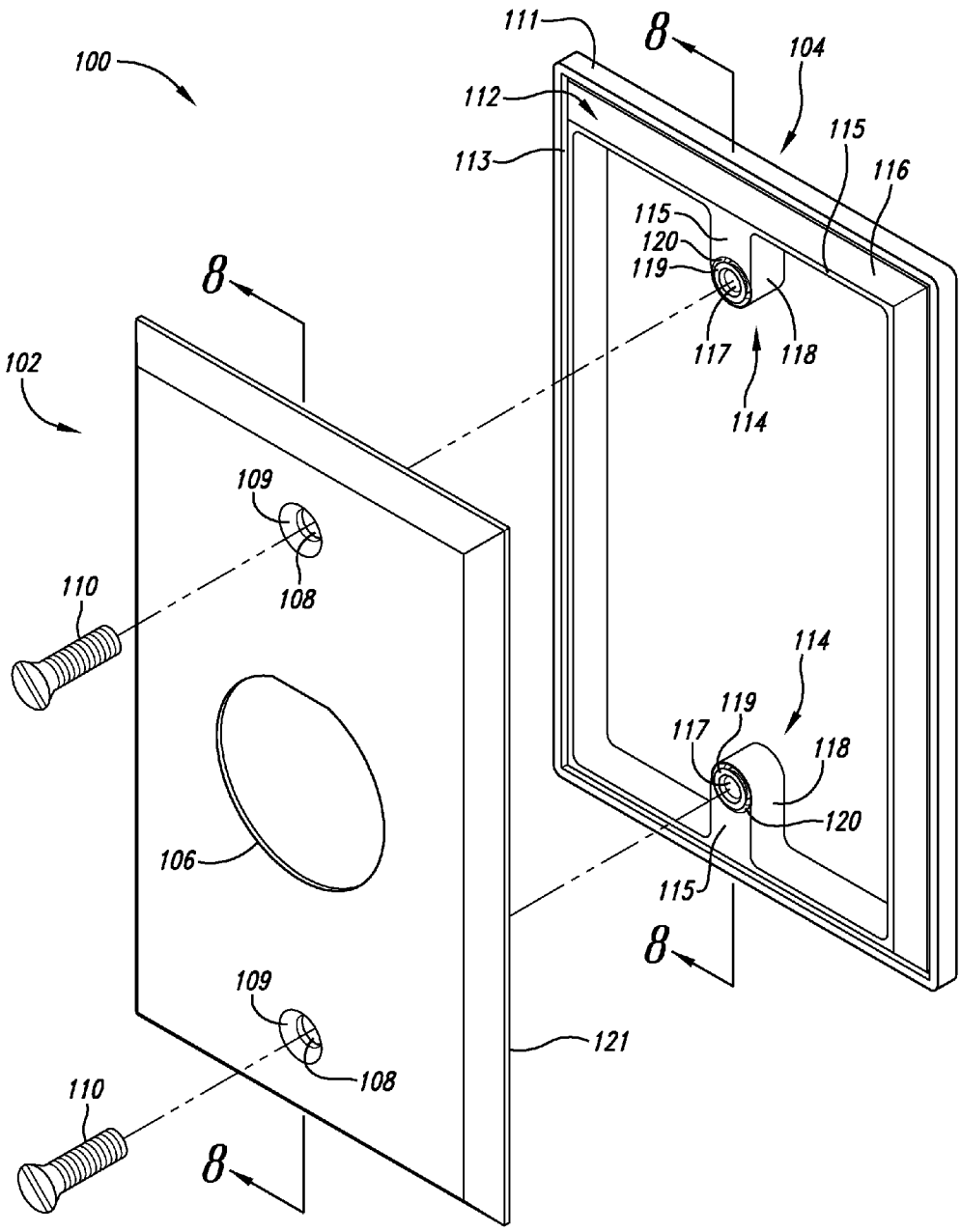
FIG. 6 is an exploded isometric front view of an integrated sealable plate assembly according to the present invention with a gasket shown separated from a plate.

An integrated sealable plate assembly 100 according to the present invention is shown in FIG. 6 as including a plate 102 and a gasket 104. The plate 102 includes a jack hole 106 sized and positioned to receive the jack assembly 8 and screw holes 108 with beveled portions 109. The screw holes 108 are sized and positioned to receive screws 110 to be used to affix the plate 102 with the conventional junction box described further below with respect to FIGS. 11 and 12.

The gasket 104 is generally shaped to conform with the plate 102 including the screw holes 108. The gasket 104 includes a peripheral frame portion that has an outer frame portion 111, an inner frame portion 112, and a groove 113 therebetween to receive an edge portion of the plate 102 further explained below. Two appendage portions 114 extend from the inner frame portion and each share a first plate sealing surface 115 that is common with both the appendage portion and the outer frame portion 111. A second plate sealing surface 116 is located on a beveled periphery of the inner frame portion 112.

The appendage portions 114 have screw holes 117 of certain diameter and sufficient depth to receive and frictionally retain the screws 110 so that the screws can be held in the plate assembly 100 while the plate assembly is being positioned for installation on the conventional junction box. Each of the appendage portions 114 further include an outer frame portion 118, an inner frame portion 119, and a groove 120 therebetween. As shown, the inner frame portions 119 bound the screw holes 117.

Figure 7:
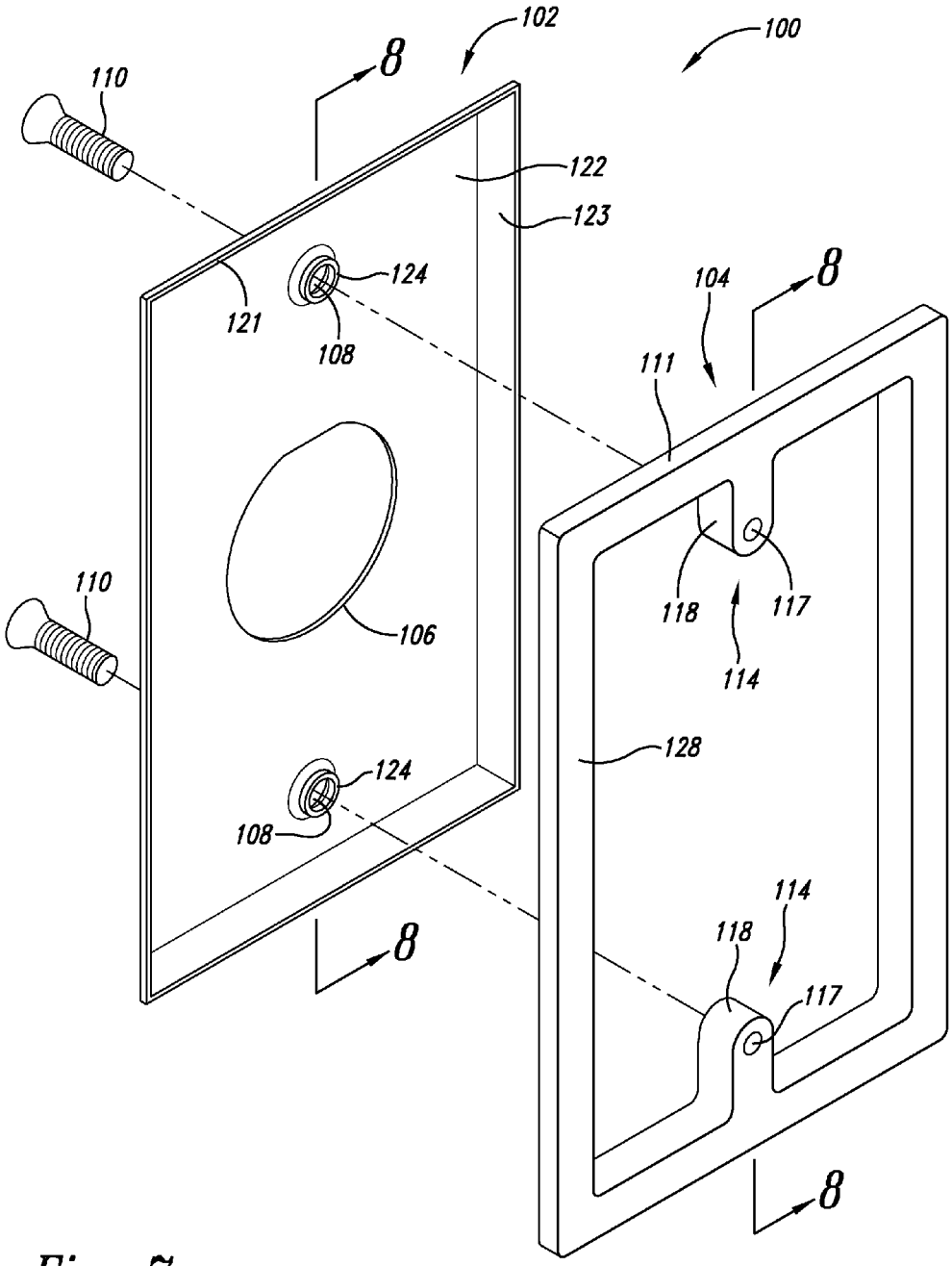
FIG. 7 is an exploded isometric rear view of the integrated sealable plate assembly of FIG. 6.

The plate 102 has a peripheral frame portion 121, a rear surface 122, and a front surface opposite the rear surface as shown in FIG. 7. The frame 121 extends from the rear surface 122 and includes a beveled surface 123. The plate 102 has round hole frame portions 124 each extending from the rear surface 122 of the plate around a different one of the screw holes 108. The gasket 104 has a junction box sealing surface 128 located on the side of the gasket opposite the plate 102.

Figure 8:
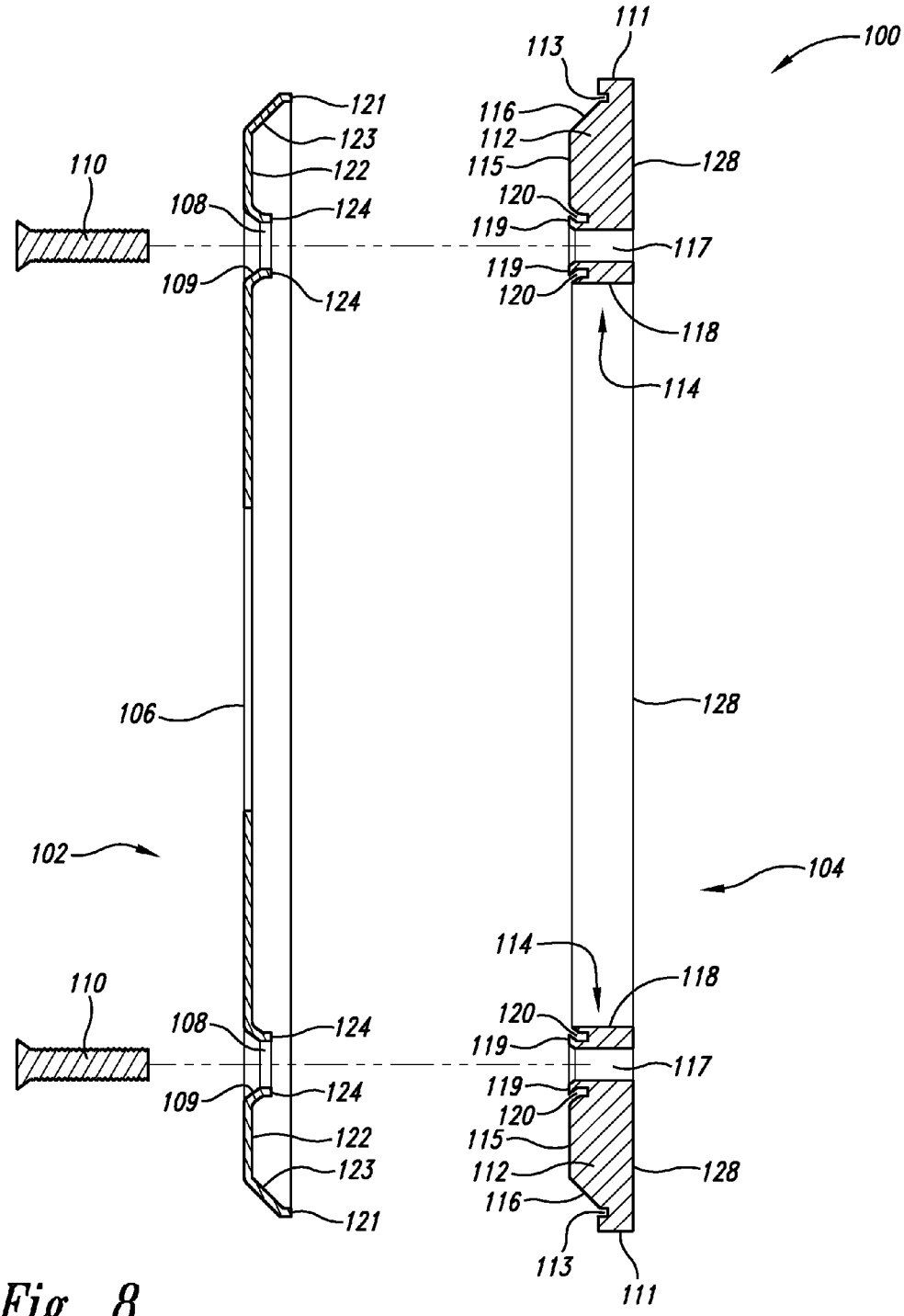
FIG. 8 is a cross-sectional view of the integrated sealable plate assembly taken substantially along the line 8—8 of FIGS. 6 and 7.
Figure 11:
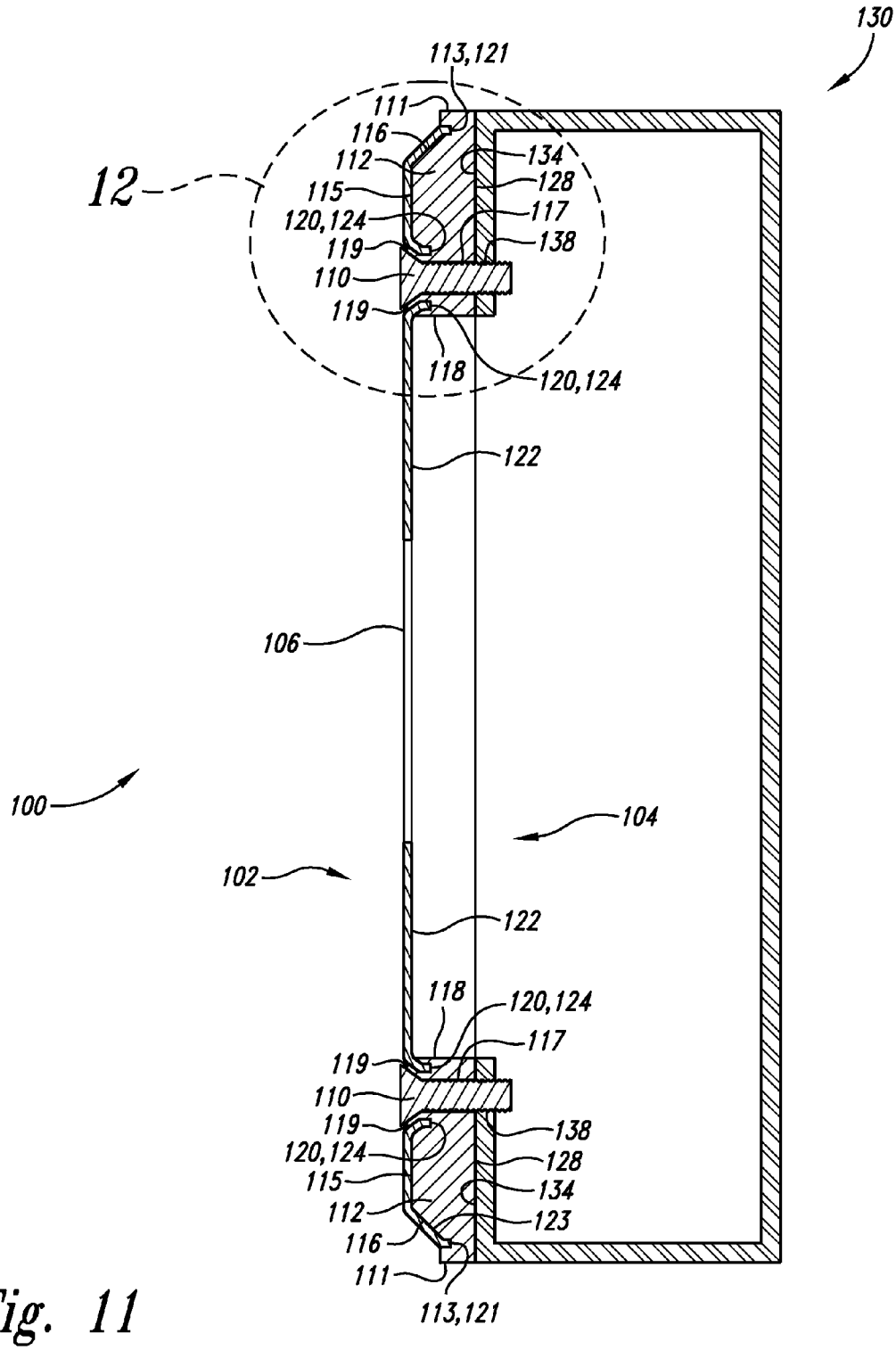
FIG. 11 is a cross-sectional view of the integrated sealable plate assembly taken substantially along the line 11—11 of FIGS. 9 and 10 shown affixed to a conventional junction box.
Figure 12:
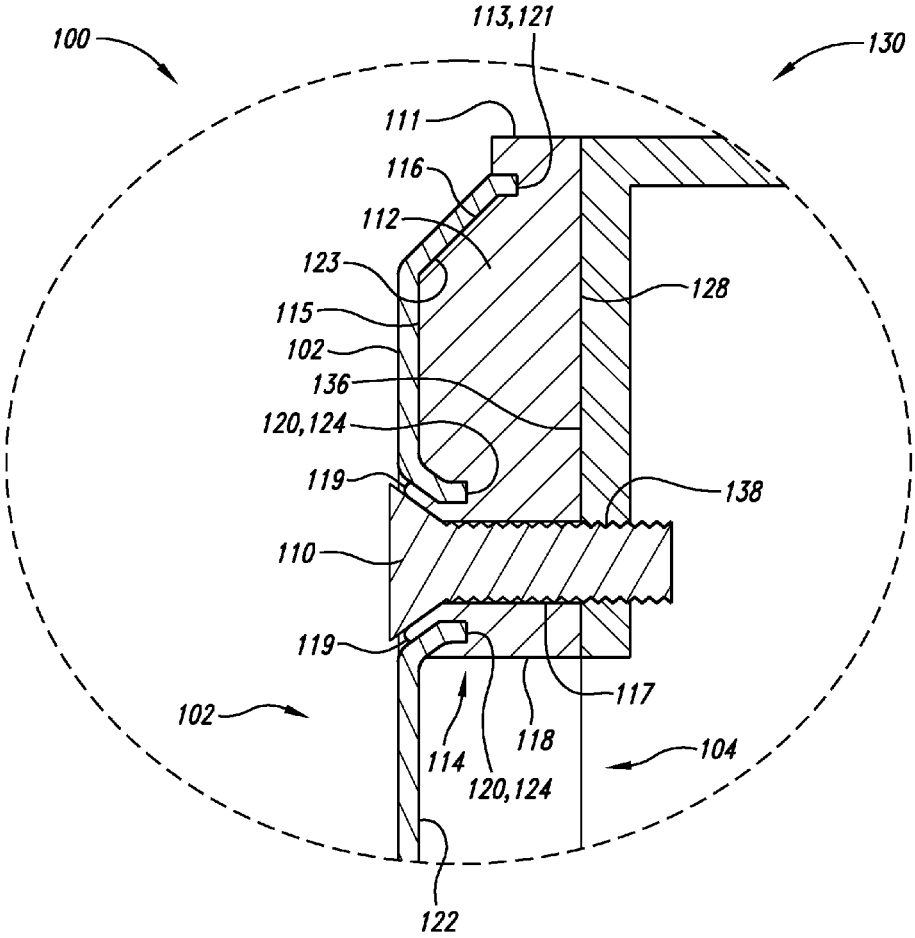
FIG. 12 is an enlarged cross-sectional view of a portion of the integrated sealable plate assembly affixed to the conventional junction box of FIG. 11.

The plate 102 and gasket 104 can be secured together by using a conventional gluing process, by using a conventional molding process, or by simply relying upon frictional forces resulting from portions of the plate being inserted into corresponding portions of the gasket when the two pieces are physically brought adjacent to one another. As stated, the gasket 104 is shaped to conform with the plate 102. As shown in FIGS. 8, 11 and 12, the groove 113 of the gasket 104 receives the frame portions 121 of the plate 102, the grooves 120 of the gasket receive the hole frame portions 124 of the plate, the first plate sealing surface 115 of the gasket is positioned to contact the rear surface 122 of the plate, and the second plate sealing surface 116 of the gasket is beveled and positioned to contact the beveled surface 123 of the plate.

Figure 9:
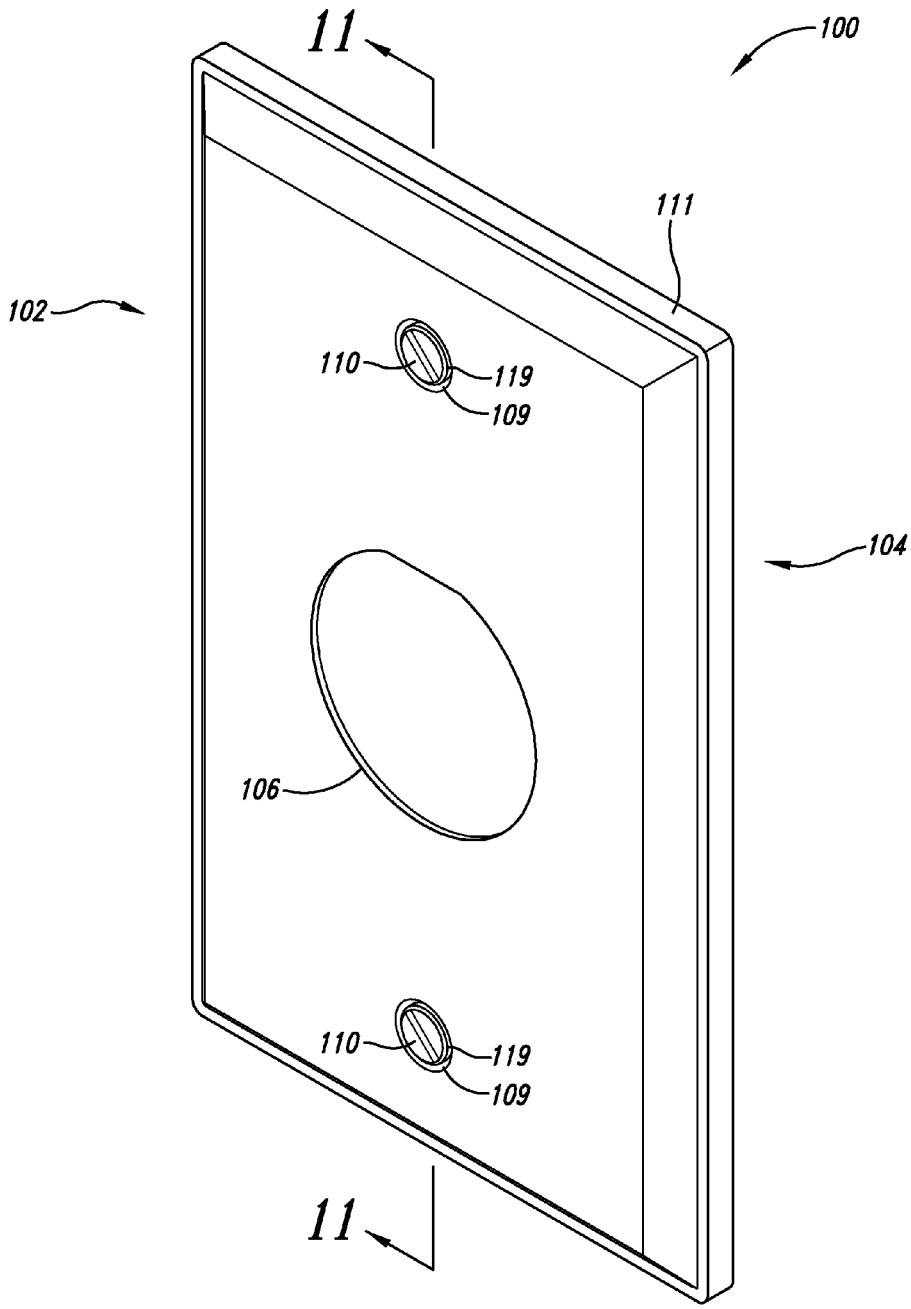
FIG. 9 is an isometric front view of the integrated sealable plate assembly of FIG. 6 shown assembled.
Figure 10:
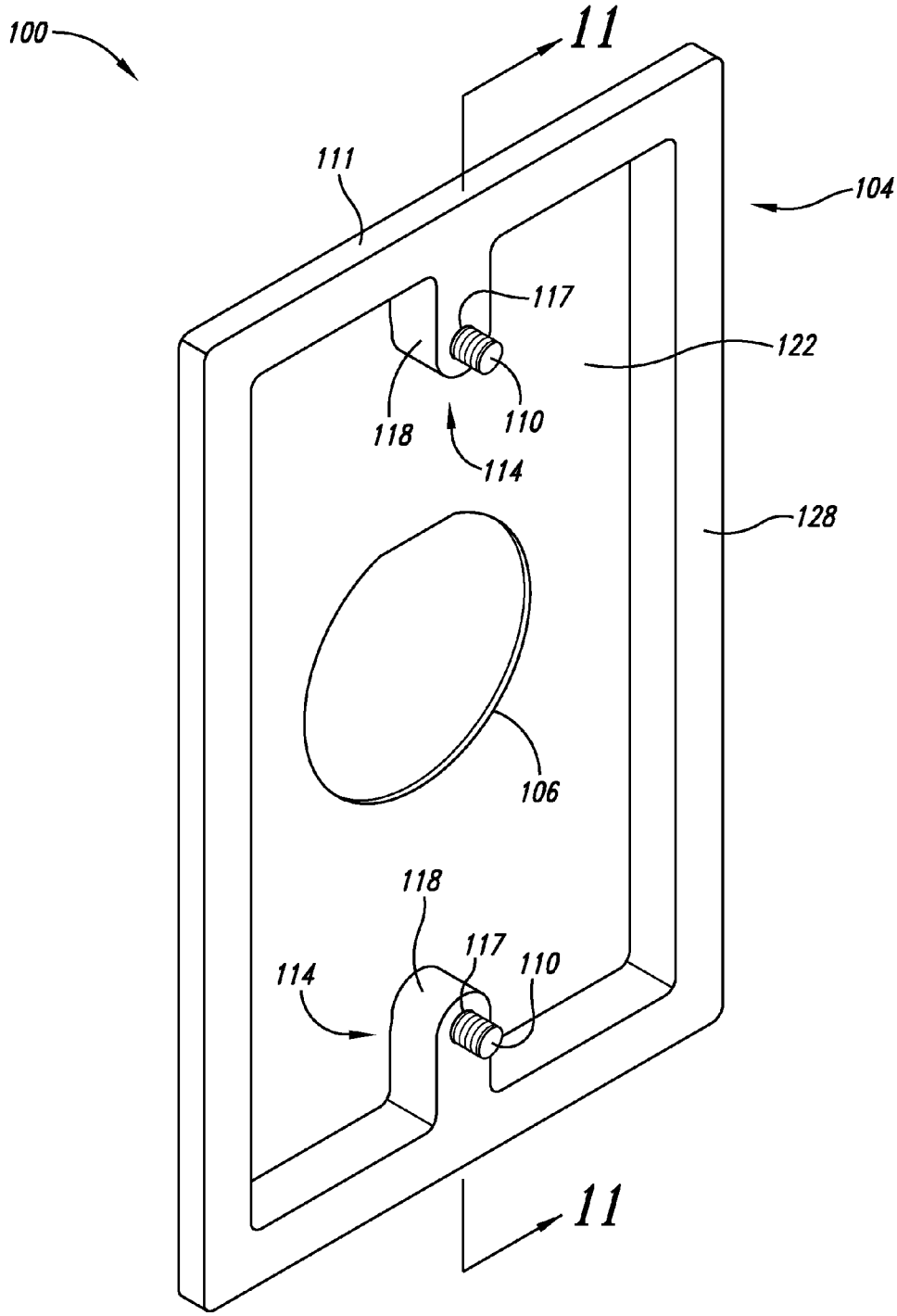
FIG. 10 is an isometric rear view of the integrated sealable plate assembly of FIG. 6 shown assembled.

As shown in FIGS. 9, 11, and 12, when the plate 102 and the gasket 104 are coupled together, a portion of each of the inner frame portions 119 of the appendage portions 114 extend through a different one of the screw holes 108 of the plate. When each of the screws 110 are inserted to pass through a different one of the screw holes 108 of the plate 102 and a different one of the screw holes 117 of the gasket 104, such as shown in FIG. 10, each of the screws presses against a different one of the inner frame portions 119 of the appendage portions 114. Each inner frame portion 119 of the appendage portions 114, in turn, presses against the beveled portion 109 of a different one of the screw holes 108 of the plate 102 causing the inner frame portion to extend further through the screw hole of the plate thereby providing substantial sealing contact with the screw 110 and the screw hole of the plate, best shown in FIG. 12.

As shown in FIGS. 11 and 12, the plate assembly 100 can be coupled to a conventional junction box 130. The junction box sealing surface 128 of the gasket 104 makes sealable contact with an external surface 134 of the junction box 130 when screw holes 138 of the junction box are aligned with the screw holes 108 of the plate 102 and are also aligned with the screw holes 117 of the gasket 104 for affixing the plate assembly 100 to the junction box with the screws 110.

Figure 13:
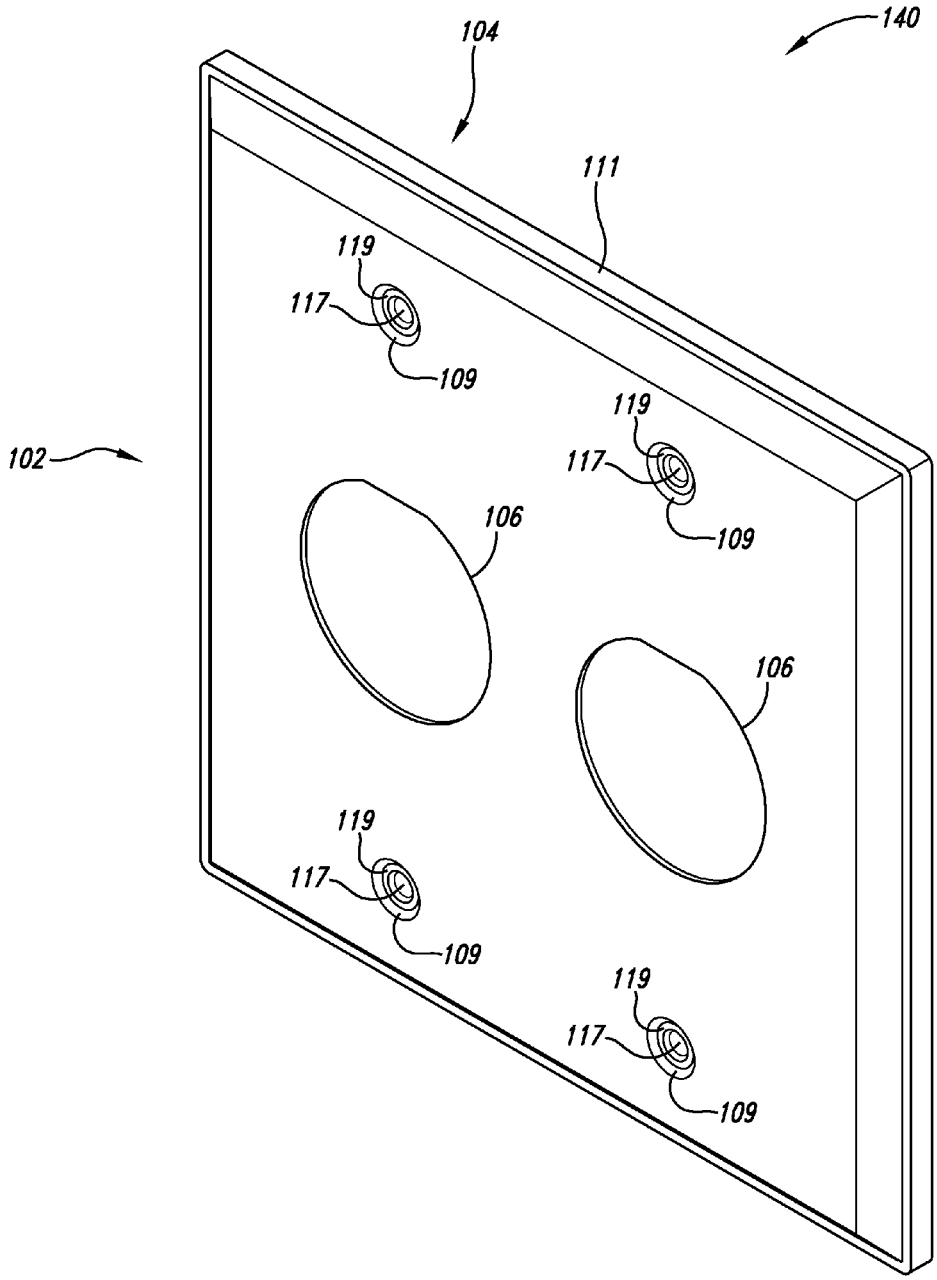
FIG. 13 is an isometric front view of a dual outlet implementation of the integrated sealable plate assembly.
Figure 14:
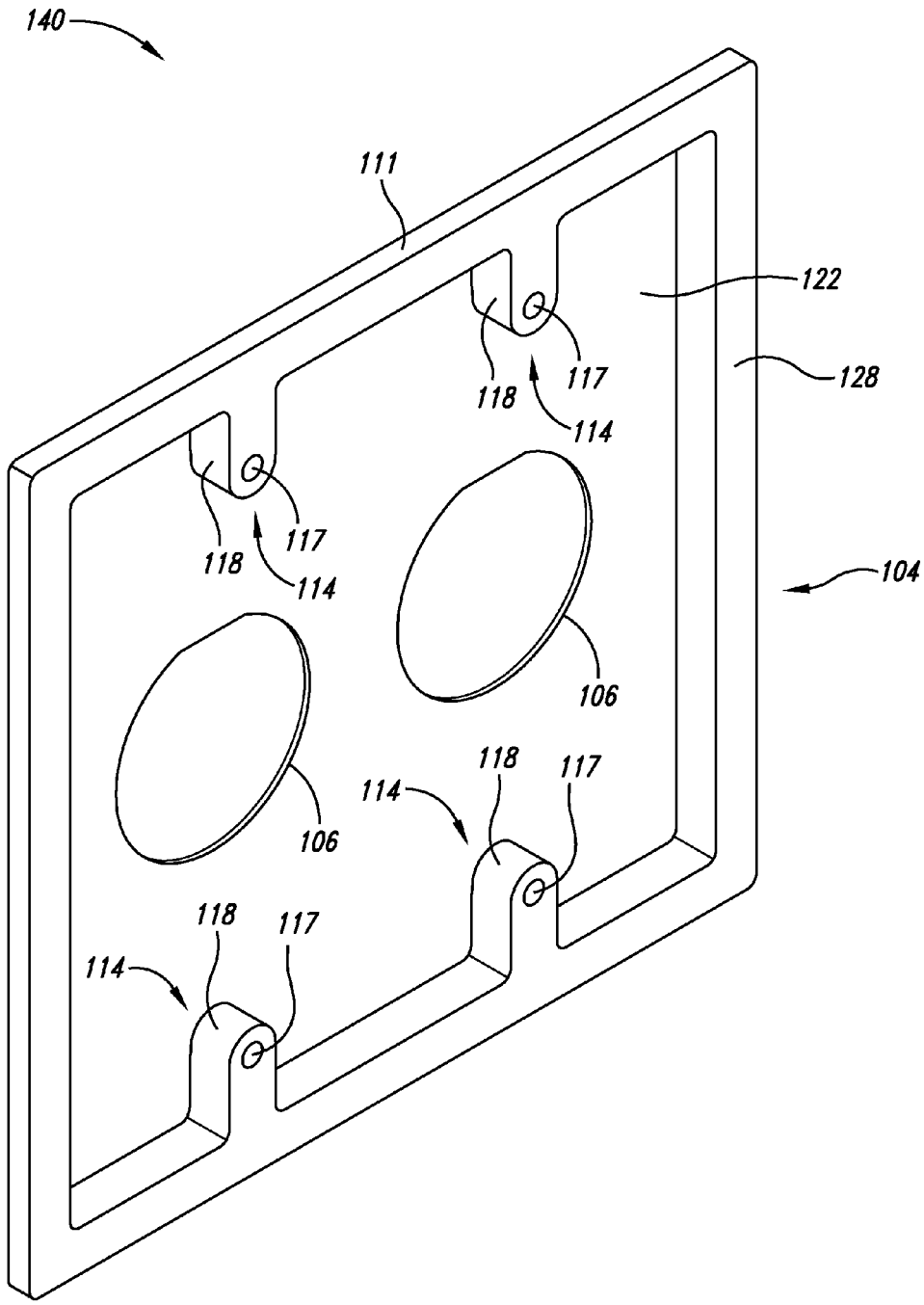
FIG. 14 is an isometric rear view of the dual outlet implementation of the integrated sealable plate assembly of FIG. 13.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. For instance, other implementations of the integrated sealable plate assembly can have other than one instance of the jack hole 106 as depicted in FIGS. 13 and 14, which show a plate assembly 140 having two jack holes 106 with corresponding additions of various other components described above. Other implementations of the integrated sealable plate assembly can have other numbers of the jack hole 106 and screw holes 108 with various other sizes than that depicted. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

The invention claimed is:

1. A system for coupling a jack assembly with a junction box, the system comprising:

a plate with a jack hole sized and positioned to correspond to the jack assembly, the plate having a peripheral frame portion, the plate having a screw hole sized to receive a screw for coupling the plate with the junction box; and a gasket having a peripheral frame portion, the peripheral frame portion shaped to sealably couple with the peripheral frame portion of the plate, the gasket having an appendage portion, the appendage portion having a screw hole sized and positioned to receive the screw when the screw has passed through the screw hole of the plate, the plate having a rear surface engagable with the peripheral frame portion of the gasket and a hole frame portion that projects from the rear surface of the plate and extends around the screw hole of the plate, and the appendage portion of the gasket including an outer frame portion and an inner frame portion, and extending about the screw hole of the gasket, a groove therebetween to receive the hole frame portion of the plate.

2. The system of claim 1 wherein the inner frame portion of the appendage of the gasket is sized to grasp the screw when the screw is positioned through the screw holes of the plate.

3. The system of claim 1 wherein the plate has a front surface opposite the rear surface of the plate, the front surface of the plate extending as a portion of the hole frame portion of the plate adjacent to the inner frame portion of the appendage, the inner frame portion of the appendage positioned and sized to seal between the screw and the front surface of plate when the screw is positioned through the screw holes of the plate and is engaged with the junction box.

4. The system for coupling a jack assembly with a junction box, the system comprising:

a plate with a jack hole sized and positioned to correspond to the jack assembly, the plate having a peripheral frame portion, the plate having a screw hole sized to receive a screw for coupling the plate with the function box; and a gasket having a peripheral frame portion, the peripheral frame portion shaped to sealably couple with the peripheral frame portion of the plate, the gasket having an appendage portion, the appendage portion having a screw hole sized and positioned to receive the screw when the screw has passed through the screw hole of plate, the plate having a rear surface engagable with the peripheral frame portion of the gasket and a hole frame portion that projects from the rear surface of the plate and extends around the screw hole of the plate, and the appendage portion of the gasket including an inner frame portion extending about the screw hole of the gasket, and the plate having a front surface opposite the rear surface of the plate, the front surface of the plate extending as a portion of the hole frame portion of the plate adjacent to the inner frame portion of the appendage, the inner frame portion of the appendage positioned and sized to seal between the screw and the front surface of plate when the screw is positioned through the screw holes of the plate and is engaged with the junction box.

5. A system for coupling a jack assembly with a junction box, the system comprising:

a plate with a jack hole sized and positioned to correspond to the jack assembly, the plate having a peripheral frame portion, the plate having a screw hole sized to receive a screw for coupling for coupling the plate with the junction box; and a gasket having a peripheral frame portion, the peripheral frame portion shaped to sealably couple with the peripheral frame portion of the plate, the gasket having an appendage portion, the appendage portion having a screw hole sized and positioned to receive the screw when the screw has passed through the screw hole of the plate, the peripheral frame portion of the plate having an edge portion and the peripheral frame portion of the gasket including a peripheral outer frame portion and a peripheral inner frame portion and a groove therebetween to receive the edge portion of the plate the plate having a rear surface engagable with the peripheral frame portion of the gasket and a hole frame portion that projects from the rear surface of the plate and extends around the screw hole of the plate, and the appendage portion of the gasket including an outer appendage frame portion and an inner appendage frame portion, and extending about the screw hole of the gasket, a groove therebetween to receive the hole frame portion of the plate.

6. The system of claim 5 wherein the inner appendage frame portion of the gasket is sized to grasp the screw when the screw is positioned through the screw holes of the plate.

7. The system of claim 5 wherein the appendage portion extends from the inner peripheral frame portion of the gasket.

8. A gasket for a plate for coupling a jack assembly with a junction box, the plate having a peripheral frame and a screw hole for receiving a screw to couple with the junction box, the plate having a rear surface and a hole frame portion that projects from the rear surface and extends around the screw hole of the plate, the gasket comprising:

a peripheral frame portion, the peripheral frame portion shaped to sealably couple with the peripheral frame portion of the plate and engagable with the rear surface of the plate; and an appendage portion, the appendage portion having a screw hole sized and positioned to receive the screw when the has passed through the screw hole of the plate, the appendage portion of the gasket including an outer frame portion and an inner frame portion, and extending about the screw hole of the gasket, a groove therebetween to receive the hole frame portion of the plate.

9. The gasket of claim 8 wherein the inner frame portion of the appendage of the gasket is sized to grasp the screw when the screw is positioned through the screw holes of the plate.

10. The gasket of claim 8 for use with the plate having a front surface opposite the rear surface of the plate, the front surface of the plate extending as a portion of the hole frame portion of the plate adjacent to the inner frame portion of the appendage, wherein the inner frame portion of the appendage is positioned and sized to seal between the screw and the front surface of plate when the screw is positioned through the screw holes of the plate and is engaged with the junction box.

11. A gasket for coupling a jack assembly with a junction box, the plate having a peripheral frame portion and screw hole for receiving a screw to couple with the junction box, the plate having a rear surface and a hole frame portion that projects from the rear surface and extends around the screw hole, the plate having a front surface opposite the rear surface of the plate, the front surface of the plate extending as a portion of the hole frame portion of the plate, the gasket comprising:

a peripheral frame portion, the peripheral frame portion shaped to sealably couple with the peripheral frame portion of the plate and engagable with the rear surface of the plate; and an appendage portion, the appendage portion having a screw hole sized and positioned to receive the screw when the screw has passed through the screw hole of the plate, the appendage portion of the gasket including an inner frame portion extending about the screw hole of the gasket, the front surface of the plate extending as a portion of the hole frame portion of the plate adjacent to the inner frame portion of the appendage, the inner frame portion of the appendage positioned and sized to seal between the screw and the front surface of plate when the screw is positioned through the screw holes of the plate and is engaged with the junction box.

12. A gasket for a plate for coupling a jack assembly with a junction box, the plate having a peripheral frame portion with an edge portion and a screw hole for receiving a screw to couple with the junction box, the plate having a rear surface and a hole frame portion that projects from the rear surface of the plate and extends around the screw hole of the plate, the gasket comprising:

a peripheral frame portion, the peripheral frame portion shaped to sealably couple with the peripheral frame portion of the plate; and an appendage portion, the appendage portion having a screw hole sized and positioned to receive the screw when the screw has passed through the screw hole of the plate, the peripheral frame portion of the gasket includes an peripheral outer frame portion and an peripheral inner frame portion and a groove therebetween to receive the edge portion of the plate, the peripheral frame portion of the gasket includes an peripheral outer frame portion and an peripheral inner frame portion and a groove therebetween to receive the edge portion of the plate, the appendage portion of the gasket including an outer appendage frame portion and an inner appendage frame portion, and extending about the screw hole of the gasket, a groove therebetween to receive the hole frame portion of the plate.

13. The gasket of claim 12 wherein the inner appendage frame portion of the gasket is sized to grasp the screw when the screw is positioned through the screw holes of the plate.

* * * * *